US008528120B2

(12) United States Patent
Underwood et al.

(10) Patent No.: US 8,528,120 B2
(45) **Date of Patent: *Sep. 10, 2013**

(54) FLAME RESISTANT FABRIC MADE FROM A FIBER BLEND

(75) Inventors: Joey K. Underwood, Greenville, SC (US); Jacques Cantin, Greenville, SC (US)

(73) Assignee: International Textile Group, Inc., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/540,757

(22) Filed: Jul. 3, 2012

(65) Prior Publication Data

US 2012/0278979 A1 Nov. 8, 2012

Related U.S. Application Data

(63) Continuation of application No. 12/702,848, filed on Feb. 9, 2010, now Pat. No. 8,209,785.

(51) Int. Cl.

| | |
|---|---|
| ***A41D 13/00*** | (2006.01) |
| ***A41D 27/02*** | (2006.01) |
| ***A41D 3/02*** | (2006.01) |
| *A41D 1/02* | (2006.01) |

(52) U.S. Cl.
USPC ..... 2/458; 2/97; 2/272

(58) Field of Classification Search
USPC ..... 2/455, 456, 458, 69, 81, 82, 87, 93, 2/97, 272, 900
See application file for complete search history.

(56) References Cited

U.S. PATENT DOCUMENTS

| | | | |
|---|---|---|---|
| 2,939,200 | A | 6/1960 | Ewing et al. |
| 3,558,267 | A | 1/1971 | Langenfeld |
| 3,628,995 | A | 12/1971 | Economy et al. |
| 3,855,356 | A | 12/1974 | Luce |
| 3,877,974 | A | 4/1975 | Mischutin |
| 3,918,901 | A | 11/1975 | Ida et al. |
| 3,974,310 | A | 8/1976 | Mischutin |
| 4,001,477 | A | 1/1977 | Economy et al. |

(Continued)

FOREIGN PATENT DOCUMENTS

| | | | |
|---|---|---|---|
| EP | 0 159 876 | A2 | 10/1985 |
| EP | 0 228 026 | A2 | 7/1987 |

(Continued)

OTHER PUBLICATIONS

"Advances in Military Protective Clothing Materials", presentation by the U.S. Dept. of the Army, Thomas H. Tassinari and Laurance Coffin, not dated, 16 pages.

(Continued)

*Primary Examiner* — Bobby Muromoto, Jr.
(74) *Attorney, Agent, or Firm* — Dority & Manning, P.A.

(57) ABSTRACT

Fire resistant garments are disclosed made from a fabric containing a fiber blend. The fiber blend contains meta-aramid fibers, fire resistant cellulose fibers, non-aromatic polyamide fibers, and optionally para-aramid fibers. The non-aromatic polyamide fibers are present in an amount sufficient to dramatically improve the abrasion resistance of the fabric without adversely interfering with the flame resistant properties. In addition to abrasion resistance, the particular blend of fibers has also been found to dramatically improve or increase various other properties. In one embodiment, the fabric is made with a herringbone weave which has been found to unexpectedly improve tear properties and porosity.

19 Claims, 1 Drawing Sheet

(56) References Cited

U.S. PATENT DOCUMENTS

| | | | | |
|---|---|---|---|---|
| 4,129,551 | A | 12/1978 | Rueter et al. | |
| 4,198,494 | A | 4/1980 | Burckel | |
| 4,385,131 | A | 5/1983 | Fracalossi et al. | |
| 4,525,168 | A | 6/1985 | Kelly | |
| 4,594,286 | A | 6/1986 | McKinney et al. | |
| 4,666,960 | A | 5/1987 | Spain | |
| 4,705,527 | A | 11/1987 | Hussamy | |
| 4,710,200 | A | 12/1987 | Cates et al. | |
| 4,722,735 | A | 2/1988 | Brodmann | |
| 4,749,378 | A | 6/1988 | Cates et al. | |
| 4,752,300 | A | 6/1988 | Johnson | |
| 4,759,770 | A | 7/1988 | Cates et al. | |
| 4,842,609 | A | 6/1989 | Johnson | |
| 4,865,906 | A | 9/1989 | Smith, Jr. | |
| 4,868,041 | A | 9/1989 | Yamagishi et al. | |
| 4,869,947 | A | 9/1989 | Kirayoglu | |
| 4,898,596 | A | 2/1990 | Riggins et al. | |
| 4,900,613 | A | 2/1990 | Green | |
| 4,911,730 | A | 3/1990 | Cates et al. | |
| 4,920,000 | A | 4/1990 | Green | |
| 4,958,485 | A | 9/1990 | Montgomery et al. | |
| 4,981,488 | A | 1/1991 | Cates et al. | |
| 4,990,368 | A | 2/1991 | Johnson et al. | |
| 4,994,317 | A | 2/1991 | Dugan et al. | |
| 5,025,537 | A | 6/1991 | Green | |
| 5,077,126 | A | 12/1991 | Green | |
| 5,136,723 | A | 8/1992 | Aldridge et al. | |
| 5,150,476 | A | 9/1992 | Statham et al. | |
| 5,191,777 | A | 3/1993 | Schnegg | |
| 5,215,545 | A | 6/1993 | Cates et al. | |
| 5,275,627 | A | 1/1994 | Cates et al. | |
| 5,306,312 | A | 4/1994 | Riggins et al. | |
| 5,316,834 | A * | 5/1994 | Matsuda et al. | 442/247 |
| 5,356,700 | A | 10/1994 | Tanaka et al. | |
| 5,388,270 | A | 2/1995 | Hewitt | |
| 5,402,362 | A | 3/1995 | Prosser | |
| 5,447,540 | A | 9/1995 | Kobayashi et al. | |
| 5,527,597 | A | 6/1996 | Stanhope et al. | |
| 5,560,990 | A | 10/1996 | Ilg et al. | |
| 5,582,912 | A | 12/1996 | McCullough, Jr. et al. | |
| 5,607,483 | A * | 3/1997 | Burkinshaw et al. | 8/650 |
| 5,694,981 | A | 12/1997 | Stanhope et al. | |
| 5,727,401 | A | 3/1998 | Statham | |
| 5,747,392 | A | 5/1998 | Xiao et al. | |
| 5,824,614 | A | 10/1998 | Gadoury | |
| 5,830,574 | A | 11/1998 | Gadoury | |
| 5,849,648 | A | 12/1998 | Kent et al. | |
| 5,873,914 | A | 2/1999 | Burkinshaw et al. | |
| 5,880,042 | A | 3/1999 | Schuster et al. | |
| 5,885,307 | A | 3/1999 | Gadoury | |
| 5,928,971 | A | 7/1999 | Ellis et al. | |
| 6,065,153 | A * | 5/2000 | Underwood et al. | 2/93 |
| 6,132,476 | A | 10/2000 | Lunsford et al. | |
| 6,136,892 | A | 10/2000 | Yamauchi et al. | |
| 6,192,520 | B1 * | 2/2001 | Underwood et al. | 2/93 |
| 6,194,329 | B1 | 2/2001 | Nelson et al. | |
| 6,215,545 | B1 | 4/2001 | Matsuyama | |
| 6,296,023 | B1 | 10/2001 | Gehrhardt et al. | |
| 6,410,140 | B1 * | 6/2002 | Land et al. | 428/377 |
| 6,451,070 | B1 | 9/2002 | Kent et al. | |
| 6,472,456 | B1 | 10/2002 | Horsey et al. | |
| 6,531,419 | B1 | 3/2003 | Wyner et al. | |
| 6,547,835 | B1 * | 4/2003 | Lunsford et al. | 8/531 |
| 6,553,749 | B2 * | 4/2003 | Land et al. | 57/5 |
| 6,562,741 | B1 | 5/2003 | Lilani | |
| 6,576,025 | B2 | 6/2003 | Lapierre | |
| 6,599,963 | B2 | 7/2003 | Horsey et al. | |
| 6,606,749 | B2 * | 8/2003 | Underwood et al. | 2/93 |
| 6,607,562 | B2 | 8/2003 | Ghorashi et al. | |
| 6,624,096 | B2 | 9/2003 | Thomas et al. | |
| 6,668,868 | B2 * | 12/2003 | Howland et al. | 139/383 R |
| 6,818,024 | B2 | 11/2004 | Lunsford et al. | |
| 6,840,967 | B1 | 1/2005 | Riggins et al. | |
| 6,867,143 | B1 | 3/2005 | Furukawa et al. | |
| 6,867,154 | B1 | 3/2005 | Lunsford et al. | |
| 6,886,184 | B2 * | 5/2005 | Underwood et al. | 2/82 |
| 6,913,720 | B2 | 7/2005 | Raponi et al. | |
| 7,008,694 | B1 | 3/2006 | Frankel | |
| 7,013,496 | B2 | 3/2006 | Dunn | |
| 7,156,883 | B2 | 1/2007 | Lovasic et al. | |
| 7,393,800 | B2 * | 7/2008 | Corner | 442/302 |
| 7,581,260 | B2 * | 9/2009 | Underwood et al. | 2/82 |
| 7,754,140 | B2 | 7/2010 | Rajner et al. | |
| RE42,209 | E | 3/2011 | Lunsford et al. | |
| 8,209,785 | B2 * | 7/2012 | Underwood et al. | 2/458 |
| 2001/0004780 | A1 | 6/2001 | Mach et al. | |
| 2002/0026663 | A1 * | 3/2002 | Underwood et al. | 2/458 |
| 2002/0124544 | A1 * | 9/2002 | Land et al. | 57/5 |
| 2003/0148689 | A1 | 8/2003 | Lapierre | |
| 2003/0167580 | A1 | 9/2003 | Lunsford et al. | |
| 2004/0034905 | A1 * | 2/2004 | Underwood et al. | 2/458 |
| 2004/0198125 | A1 * | 10/2004 | Mater et al. | 442/394 |
| 2005/0025962 | A1 * | 2/2005 | Zhu et al. | 428/359 |
| 2005/0060820 | A1 | 3/2005 | Lunsford et al. | |
| 2005/0130533 | A1 | 6/2005 | Lapierre | |
| 2005/0155131 | A1 * | 7/2005 | Underwood et al. | 2/85 |
| 2005/0208856 | A1 * | 9/2005 | McKee et al. | 442/302 |
| 2005/0277353 | A1 | 12/2005 | Lovasic et al. | |
| 2006/0068675 | A1 * | 3/2006 | Handermann et al. | 442/415 |
| 2006/0160454 | A1 * | 7/2006 | Handermann et al. | 442/415 |
| 2006/0201128 | A1 * | 9/2006 | Paire et al. | 57/210 |
| 2007/0249247 | A1 * | 10/2007 | Truesdale et al. | 442/136 |
| 2007/0249250 | A1 * | 10/2007 | Servajean | 442/184 |
| 2007/0298668 | A1 * | 12/2007 | DeFranks | 442/59 |
| 2008/0057807 | A1 * | 3/2008 | Tutterow et al. | 442/1 |
| 2008/0104743 | A1 * | 5/2008 | Ng | 2/458 |
| 2008/0113175 | A1 * | 5/2008 | Ke | 428/221 |
| 2008/0134407 | A1 | 6/2008 | Winterhalter et al. | |
| 2008/0153372 | A1 | 6/2008 | Truesdale et al. | |
| 2008/0295232 | A1 * | 12/2008 | Truesdale et al. | 2/458 |
| 2009/0049579 | A1 * | 2/2009 | Roberts | 2/81 |
| 2009/0188017 | A1 * | 7/2009 | Kruse | 2/81 |
| 2010/0107443 | A1 * | 5/2010 | Aveni | 36/84 |
| 2010/0112312 | A1 * | 5/2010 | Tutterow et al. | 428/196 |
| 2011/0023206 | A1 | 2/2011 | Dunn et al. | |

FOREIGN PATENT DOCUMENTS

| | | | |
|---|---|---|---|
| EP | 0 237 451 | A1 | 9/1987 |
| EP | 0 314 244 | A2 | 5/1989 |
| EP | 0 330 163 | A2 | 8/1989 |
| EP | 0 385 024 | A1 | 9/1990 |
| EP | 0 432 100 | A2 | 6/1991 |
| EP | 0 487 568 | A1 | 6/1992 |
| EP | 0 557 734 | A1 | 9/1993 |
| EP | 0 111 124 | | 6/1994 |
| EP | 0 875 620 | A1 | 11/1998 |
| GB | 2 332 001 | | 6/1999 |
| JP | 63196741 | | 8/1988 |
| JP | 2182936 | | 7/1990 |
| JP | 2221432 | | 9/1990 |
| JP | 4263646 | | 9/1992 |
| JP | 8226031 | | 9/1996 |
| JP | 9296335 | | 11/1997 |
| JP | 10060787 | | 3/1998 |
| WO | WO 90/06229 | A1 | 6/1990 |
| WO | WO 91/02837 | A1 | 3/1991 |
| WO | WO 93/19241 | A1 | 9/1993 |
| WO | WO 94/25665 | A1 | 11/1994 |
| WO | WO 98/12373 | A1 | 3/1998 |
| WO | WO 98/54399 | A1 | 12/1998 |
| WO | WO 99/35315 | A1 | 7/1999 |
| WO | WO 2009/012266 | A2 | 1/2009 |
| WO | WO 2009/012266 | A9 | 1/2009 |

OTHER PUBLICATIONS

"Aramid fibres", J.E. McIntyre, Rev. Prog. Coloration, vol. 25, 1995, pp. 44-56.

"Clothing for Work and Protection", R. Jeffries, Lenzinger Berichte, Aug. 1989, pp. 25-33.

"Demand Heats Up", Doug Jackson, Safety & Protective Fabrics, Sep. 1992, pp. 32-35.

"Flame Retardant Viscose Rayon Containing a Pyrophosphate", Rainer Wolf, Ind. Eng. Chem. Prod. Res. Dev., 1981, vol. 20, pp. 413-420.
"In the heat of combat, Flame-Resistant, Protective Apparel of NOMEX gives you a fighting chance", DuPont NOMEX Brochure, 1996, 8 pages.
"Measuring the Effects of Intense Heat and Dynamic Mechanical Forces on Thermal Protective Fabrics", Geshury et al., High-Tech Fibrous Materials, ACS Symposium Series, American Chemical Society, 1991, pp. 278-292.
DuPont NOMEX IIIA brochure, 1994, 5 pages.
DuPont NOMEX Laundering Guide, 1997, 22 pages.
Technical Guide for NOMEX Brand Fiber, 2001, 40 pages.
"Novel Approach to Soldier Flame Protection" Presentation by U.S. Army Natick Soldier Center, Winterhalter and Martin, 2011, 22 pages.
Novel Polymer Solutions, http://www.novelpolymers.co.uk, at least as early as Apr. 12, 2011, 2 pages.
"Novel Approach to Soldier Flame Protection", Winterhalter et al., Journal of ASTM International, Feb. 2005, Fol. 2, No. 2, pp. 227-234.
DuPont KARVIN brochure, not dated, 4 pages.
"Printing Technology for Aramid Fabrics", Hodge et al., High-Tech Fibrous Materials, ACS Symposium Series, American Chemical Society, 1991, pp. 270-276.
"Properties and Processing Guidelines for Lenzing FR", not dated, 21 pages.
"Protective Clothing of DuPont NOMEX and Heat Stress", brochure, 2000, 2 pages.
"The Dyeing, Finishing and Performance of Fabrics for Military Uniforms", John V. Morris, Rev. Prog. Coloration, vol. 11, 1981, pp. 9-18.
TL 8415-0235, 2008, 21 pages.
"Dyeing and Finishing of KARVIN", Sep. 1982, 7 pages.
"The Processing of KARVIN in Modified Cotton Spinning and in Weaving Mills", Sep. 1982, 6 pages.
"Yarns, Fabrics and Garments made with KARVIN", Sep. 1982, 13 pages.
International Search Report, PCT/US2011/023955, mailed Jul. 15, 2011.
International Preliminary Report on Patentability, PCT/US2011/023955, mailed Aug. 14, 2012.

* cited by examiner

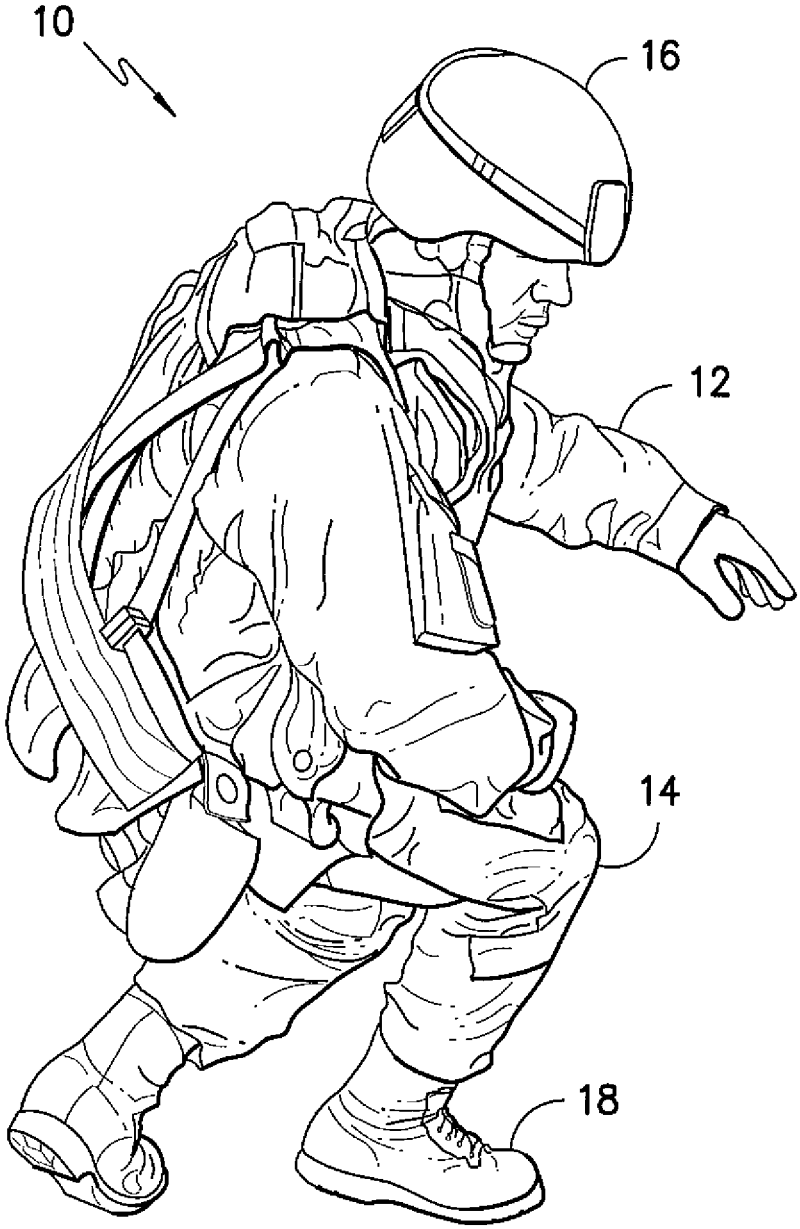
10
16
12
14
18

FLAME RESISTANT FABRIC MADE FROM A FIBER BLEND

RELATED APPLICATIONS

The present application claims priority to and is based upon U.S. patent application Ser. No. 12/702,848, filed on Feb. 9, 2010, and which is incorporated herein by reference.

BACKGROUND

Military personnel are issued and wear many different types of clothing items depending upon the actions they are performing, the climate they are working in, and based on various other factors. Such clothing items can include, for instance, pants, shirts, coats, hats, jackets, and the like. The clothing items are intended not only to keep the wearer warm and sheltered from the elements but to also provide protection, especially in combat areas.

Recently, greater attention has been focused on developing garments for military personnel that have fire resistant properties. The fire resistant properties are intended to protect the wearer when exposed to flash fires. The push to increase the fire resistant properties of clothing worn by military personnel is primarily in response to the various different types of incendiary devices that military personnel may be exposed to in the field.

In the past, in order to produce fabrics having fire resistant properties, the fabrics were typically made from inherently flame resistant fibers. Such fibers, for instance, may comprise aramid fibers such as meta-aramid fibers or para-aramid fibers. Such fibers, for instance, are typically sold under the trade names NOMEX® or KEVLAR® or TWARON®. The use of inherently flame resistant fibers to produce garments, such as those worn by military personnel, are disclosed in U.S. Pat. No. 4,759,770, U.S. Pat. No. 5,215,545, U.S. Pat. No. 6,818,024, U.S. Pat. No. 7,156,883, U.S. Pat. No. 4,981,488 and U.S. Pat. No. 6,867,154 which are all incorporated herein by reference.

Although the use of inherently flame resistant fibers can produce garments having excellent flame resistant properties, the above fibers do have some disadvantages and drawbacks. For example, the fibers are relatively expensive. The fabrics also do not have favorable moisture management properties for many applications. Fabrics made from inherently flame resistant fibers are also difficult to dye and/or print, thus making it difficult to apply a camouflage pattern to the fabrics.

In view of the above, those skilled in the art have attempted to produce flame resistant fabrics containing inherently flame resistant fibers as described above combined with cellulose fibers, namely cellulose fibers that have been pretreated with a fire resistant composition. Such fibers include, for instance, FR rayon fibers, FR acetate fibers, and FR lyocell fibers. The cellulose fibers have been added to the fabrics in order to make the garments more comfortable by improving the moisture management properties and improving the hand of the fabric. Cellulose fibers can also be readily dyed and readily accept printed patterns.

Although cellulose fibers do increase the comfort of the fabrics, various problems have been experienced in blending the two fibers together. For example, problems have been experienced in maintaining the fire resistant properties of the fabric and in dying or applying camouflage patterns to the fabric due to the presence of the aramid fibers. In addition, the fabrics are simply not exhibiting sufficient durability in many applications, especially when the fabrics have to be worn by military personnel.

In view of the above, a need currently exists for improved fire resistant fabrics made from a blend of fibers.

SUMMARY

In general, the present disclosure is directed to a flame resistant fabric and to garments made from the fabric. The flame resistant fabric is made from a fiber blend. The fiber blend includes inherently flame resistant fibers in combination with flame resistant cellulose fibers. The cellulose fibers are combined with the inherently flame resistant fibers in amounts sufficient to improve the moisture management properties of the fabric without significantly compromising the fire resistant properties of the fabric. In one embodiment, the fiber blend can further contain polyamide fibers, such as nylon fibers. The nylon fibers are present in the blend in an amount sufficient to dramatically increase the durability of the fabric without adversely impacting any of the other properties of the fabric, especially the fire resistant properties of the fabric.

In one embodiment, for instance, the present disclosure is directed to a garment with flame resistant properties. The garment has a shape to cover at least a portion of the wearer's body and is made from a woven fabric containing a plurality of yarns. The yarns are made from a plurality of fibers. The plurality of fibers include, in one embodiment, meta-aramid fibers in an amount from about 30% to about 60% by weight of the fabric; flame resistant cellulose fibers in an amount from about 20% to about 50% by weight of the fabric; nylon fibers in an amount from about 12% to about 25% by weight of the fabric; and optionally para-aramid fibers in an amount up to about 15% by weight of the fabric. For instance, in one embodiment, the fabric may contain para-aramid fibers in an amount from about 3% to about 15% by weight of the fabric. The yarns used to create the fabric can be made from an intimate blend of the above described fibers.

The flame resistant cellulose fibers contained within the fabric may comprise cellulose fibers that have been pretreated with a fire resistant composition. The cellulose fibers may comprise, for instance, cotton fibers, rayon fibers, mixtures thereof, or the like. The flame resistant composition may contain, for instance, a phosphorous compound or a halogen compound.

As described above, the fabrics made in accordance with the present disclosure can be relatively lightweight and can be wear resistant. For instance, the fabric can have a basis weight of less than about 9 osy, such as from about 2 osy to about 9 osy. In addition, the fabric can have a taber abrasion resistance of at least about 1000 cycles according to ASTM Test No. D3884 (2007 version using wheel H18 with 500 gram weight).

Garments made according to the present disclosure have numerous applications. The garments, for instance, are particularly well suited for being worn by those in the military or those having jobs relating to public safety, such as firemen and policemen. The garments made according to the present disclosure are also particularly well suited for use in industrial settings. When designed for military applications, the garments can be printed with a camouflage pattern that may be difficult to detect using night vision goggles.

In an alternative embodiment, the present disclosure is directed to a garment made from a fabric with flame resistant properties. Similar to the embodiment described above, the fabric is made from a plurality of yarns and the yarns are made from a plurality of fibers including inherently flame resistant fibers and cellulose fibers that have been treated with a flame resistant composition. In this embodiment, however, the fabric comprises a woven fabric having a herringbone weave. The present inventors discovered that various properties are unexpectedly and dramatically improved when constructing the garment with a fabric having a herringbone weave.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying FIGURE, in which:

FIG. 1 is a perspective view of one embodiment of a garment made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to flame resistant garments made from a fabric having flame resistant properties. In one embodiment, the fabric is made from a blend of fibers that, when blended in certain relative amounts, results in a fabric having a broad spectrum of desirable properties.

For instance, fabrics made in accordance with the present disclosure have excellent strength properties, improved fire resistant properties in comparison to many commercially available fabrics, have excellent hand and moisture management properties, are more abrasion resistant than many prior art fabrics, have excellent break open properties, and have excellent shrinkage control properties.

The present disclosure is also directed to a fabric made from a blend of fibers that has a particular type of weave. In particular, fabrics constructed with a herringbone weave have been found to have unexpectedly improved properties.

As described above, the flame resistant fabric of the present disclosure generally contains a blend of fibers. The blend of fibers includes inherently flame resistant fibers and cellulose fibers. The cellulose fibers, for instance, can comprise cellulose fibers that have been pretreated with a flame resistant composition to make the fibers flame retardant. There are many advantages and benefits to combining inherently flame resistant fibers with flame resistant cellulose fibers. Combining flame resistant cellulose fibers with inherently flame resistant fibers, for instance, can produce fabrics that have improved moisture management properties and generally more comfortable to wear. The fabrics can also have better drape properties and surface texture. In addition, the fabrics can be easier to dye and may more readily accept a printed pattern.

In this regard, in the past, various different fabrics have been proposed that include a combination of inherently flame resistant fibers and flame resistant cellulose fibers. For instance, such fabrics are disclosed in U.S. Pat. No. 4,981,488, U.S. Pat. No. 6,867,154 and U.S. Pat. No. 7,156,833, which are all incorporated herein by reference. Unfortunately, fabrics made substantially from inherently flame resistant fibers and cellulose fibers have various drawbacks and deficiencies. In particular, the fabrics sometimes do not have acceptable durability. Also, the fabrics tend to be relatively expensive, especially fabrics containing high amounts of para-aramid fibers.

In this regard, the present disclosure is directed to further improvements in flame resistant fabrics made from fiber blends. In this regard, in addition to inherently flame resistant fibers and flame resistant cellulose fibers, fabrics according to the present disclosure can also contain non-aromatic polyamide fibers, such as nylon fibers. The present inventors discovered that when the above fibers are combined with other fibers according to carefully controlled ratios, a flame resistant fabric can be produced that has a broad spectrum of excellent properties, including durability.

In one embodiment, the inherently flame resistant fibers contained in the fiber blend comprise meta-aramid fibers. Optionally, other inherently flame resistant fibers may be present in the blend, such as para-aramid fibers. When present, the para-aramid fibers are added in amounts much less than the meta-aramid fibers. For instance, the para-aramid fibers may be present in an amount less than about 15% by weight, such as from about 3% to about 15% by weight. The para-aramid fibers can be present in an amount sufficient to reduce shrinkage of the fabric and to provide greater strength to the fabric. The amount of para-aramid fibers, however, can be minimized in order to maintain a lower cost. Para-aramid fibers are available from numerous commercial sources. In one embodiment, for instance, the para-aramid fibers may comprise fibers sold under the trade name KEVLAR® available from E.I. duPont de Nemours and Company.

As described above, in one embodiment, most of the inherently flame resistant fibers present in the fiber blend comprise meta-aramid fibers, which are also known as fibers comprised of poly (metaphenylene isophthalamide). Meta-aramid fibers are available from numerous commercial sources. For instance, in one embodiment, the meta-aramid fibers may comprise NOMEX® fibers sold by E.I. duPont de Nemours and Company. The meta-aramid fibers are present in the fiber blend in an amount of at least about 30% by weight, such as from about 30% by weight to about 60% by weight. In one embodiment, for instance, the meta-aramid fibers are present in the fiber blend in an amount from about 40% to about 50% by weight. When present in the above amounts, the meta-aramid fibers provide the resulting fabric with significant flame resistant properties.

The meta-aramid fibers contained in the fabric can be substantially amorphous, crystalline, or a mixture of both. Amorphous meta-aramid fibers, for instance, generally have a crystallinity of less than about 10%. Crystalline fibers, on the other hand, generally have a crystallinity of greater than 10%, such as greater than 25%, such as having a crystallinity of from about 25% to about 40%.

In addition to meta-aramid fibers and optionally para-aramid fibers, the fiber blend can also contain flame resistant cellulose fibers. As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different sources. FR rayon fibers, for instance, are sold under the name LENZING® by Lenzing Fibers of Austria. LENZING FR fibers are viscous fibers that have been treated with a flame resistant composition. In one embodiment, the flame resistant rayon fibers are made by spinning reconstituted cellulose from beech trees. Such fibers are more water absorbent than cotton fibers.

The amount of flame resistant cellulose fibers present in the fiber blend may depend upon various different factors and the particular application. In one embodiment, for instance, the flame resistant cellulose fibers may be present in the fiber blend in an amount from about 20% to about 50% by weight. In one particular embodiment, for instance, the flame resistant cellulose fibers may be present in the fiber blend in an amount from about 30% to about 35% by weight. At the above weight percentages, the cellulose fibers provide the advantages described above without significantly impacting flame resistance.

As described above, flame resistant cellulose fibers comprise fibers that have been treated with a flame resistant composition. The flame resistant composition can be incorporated into the fibers using various methods and techniques. For instance, the flame resistant composition can be incorporated into the fibers during spinning, can be coated on the fibers, or can be absorbed into the fibers. The flame resistant composition may contain, for instance, a phosphorus compound, a halogen compound, or any other suitable flame resistant agents.

In addition to the above fibers, the fiber blend of the present disclosure can further contain fibers that increase the durability of the fabric. For instance, in one embodiment, non-aromatic polyamide fibers may be incorporated into the fiber blend, such as nylon fibers. The amount of non-aromatic polyamide fibers incorporated into the fiber blend can be carefully controlled so as to maintain the desirable flame resistant properties of the fabric while increasing the durability of the fabric, namely the abrasion resistance. In this regard, the non-aromatic polyamide fibers may be present in the fiber blend in an amount from about 12% to about 25% by weight, and particularly from about 15% to about 20% by weight.

Of particular importance, in one embodiment, the non-aromatic polyamide fibers are substantially pure and contain no other fillers or other ingredients. Using substantially pure non-aromatic polyamide fibers, for instance, has been found to dramatically improve the abrasion resistance of the fabric if controlled within the above described amounts. When added in the above described amounts, the non-aromatic polyamide fibers also do not substantially compromise the flame resistant properties of the overall fabric. In one embodiment, the fabric can have a taber abrasion resistance of at least about 1000 cycles when tested according to ASTM Test No. D3884 (2007 version using wheel H18 with a 500 gram weight). For instance, the fabric can have a taber abrasion resistance of at least about 1200 cycles, at least about 1300 cycles, at least about 1500 cycles, or even at least about 1700 cycles when tested according to the above described standards. Of particular advantage, the above abrasion resistance characteristics can be obtained on fabrics having a basis weight less than about 8 osy, such as less than about 7 osy, such as from about 2 osy to about 6 osy.

In the past, those skilled in the art have been reluctant to incorporate synthetic fibers, such as nylon fibers, into flame resistant fabrics, especially flame resistant fabrics for use by military personnel. Such synthetic fibers, for instance, have a tendency to melt and drip when exposed to an open flame. The present Inventors discovered, however, that the abrasion resistance of the fabric can be dramatically improved without the above disadvantages occurring at any unacceptable levels when the amount of the fibers are carefully controlled in conjunction with the proportions or amounts of the other fibers.

The fiber blend as described above is used to form yarns that are then woven or knitted into a fabric. In one embodiment, the fiber blend is made of substantially staple fibers, which are fibers having a determined length. The staple fibers, for instance, may have lengths of less than about 5 inches in one embodiment. When using staple fibers, the resulting yarns are spun from the fiber blend. Although each yarn may be made from a different type of fiber, in one embodiment, the yarns are all made from an intimate blend of the mixture of fibers.

In addition to staple fibers, all or some of the yarns may also be made from continuous fibers, such as filaments. The yarns, for instance, can have a yarn count between about 8 and about 55.

Once the yarns are constructed, the yarns can be woven into any suitable fabric. In general, the fabric may have a basis weight of less than about 9 osy. For instance, the fabric may have a basis weight of from about 2 osy to about 9 osy, such as from about 4 osy to about 7 osy, and in one embodiment, from about 5 osy to about 6 osy. The weight of the fabric, however, may depend upon the type of garment to be produced.

When producing a woven fabric, the fabric can have any suitable weave. For instance, the fabric can have a plain weave, a twill weave, or a whip stop weave. In one embodiment, however, the fabric can be made with a herringbone weave. The present inventors discovered that using a herringbone weave unexpectedly and dramatically improves some of the properties of the fabric. The herringbone weave, for instance, increases the tear properties of the fabric and increases the porosity of the fabric. In fact, the porosity of the fabric can be improved to an extent that a wearer will noticeably be more comfortable in the fabric, especially when exposed to certain environmental conditions.

In addition to and instead of being treated with a flame resistant composition, the fabric can also be treated with various other compositions. For instance, in one embodiment, the fabric can be treated with a durable water resistant treatment. The durable water resistant treatment may comprise, for instance, a fluoropolymer. Other treatments that may be applied to the fabric include insect repellants and/or a moisture management finish.

Fabrics made according to the present disclosure can be dyed and/or printed prior to or after being formed into a garment. Further, the fibers used to form the fabric can be producer dyed or non-producer dyed depending upon the application.

In one particular embodiment, the fabric can be woven or knitted and then dyed a particular base shade. Once dyed, any suitable pattern can then be printed on the fabric. For instance, in one embodiment, a pattern can be printed onto the fabric using a rotary screen printing method. Once the pattern is applied to the fabric, the dye applied to the fabric during the printing process can be developed. In one embodiment, for instance, the fabric can be padded with a solution containing an alkali and reducing agent along with cornstarch. A steamer can drive a reaction that converts the dye into the reduced or leuco state. Once converted into a reduced form, the dyes, which may comprise vat dyes, become water soluble. After the dyes are reduced, the fabric goes through a rinse section before entering an oxidation step. For instance, the fabric can be contacted with an aqueous solution containing an oxidizing agent, such as a potassium iodide/acetic mixture. In another embodiment, hydrogen peroxide may be used as the oxidizing agent. Once oxidized, the dyes convert into their insoluble form and remain well affixed to the fabric.

In one embodiment, a camouflage pattern may be applied to the fabric, especially when the fabric is to be used in constructing military garments and/or hunting garments. A camouflage pattern, for instance, is intended to provide concealment properties to the wearer in both the human visible light range and the near infrared range. The camouflage pattern, for instance, may include at least 4 colors using dyes that in combination produce a range of reflectance values similar to that of the background environment in which the garment is to be used. In one embodiment, for instance, the dyes used to form the camouflage pattern may comprise low reflectance dyes that have a reflectance of less than about 70% over a range of wavelengths of from about 600 mm to about 1000 mm.

Fabrics constructed in accordance with the present disclosure can be used to construct numerous different types of products for use in various applications. In one embodiment, for instance, the fabrics can be used to produce garments including any suitable clothing articles. Due to the improved flame resistant properties, the fabrics are particularly well suited for constructing military garments, garments worn by firefighters and other security personnel, and garments worn in industrial settings. Garments made according to the present disclosure may include shirts, pants, bib overalls, socks and other leg wear, gloves, scarves, hats, face shields, shoes, and the like.

For instance, in one embodiment, as shown in FIG. 1, the fabric can be used to produce a battle dress uniform 10. As shown, the battle dress uniform 10 can include a shirt or jacket 12, trousers 14, a hat 16, and boots 18. The fabric of the present disclosure can be used to produce any of these clothing articles.

The present disclosure may be better understood with reference to the following examples.

Example No. 1

Three fabrics were made according to the present disclosure containing the following fiber blend (Sample Nos. 1, 2 and 3):

6% by weight KEVLAR para-aramid fibers
32% by weight LENZING FR cellulose fibers
17% by weight nylon fibers
45% NOMEX meta-aramid fibers The above fiber blend was used to form yarns that were woven into the fabrics. The fabrics had a basis weight of 6.5 osy or 6.0 osy and had a herringbone or a twill weave.

Each of the above fabrics were then tested for abrasion resistance using ASTM Abrasion Test No. D3884 (2007 version using wheel H18 with 500 gram weight). For purposes of comparison, a commercially available fabric was also tested. The commercially available fabric was sold under the trade name DEFENDER M by Southern Mills Corporation. The commercially available fabric is believed to be made from the following fiber blend:

25% KEVLAR
65% LENZING
10% nylon

The following results were obtained:

| | Basis weight (osy) | Abrasion Resistance (cycles) | Weave |
|---|---|---|---|
| Sample No. 1 | 6.5 | 1300 | Twill |
| Sample No. 2 | 6.0 | 1500 | Twill |

-continued

| | Basis weight (osy) | Abrasion Resistance (cycles) | Weave |
|---|---|---|---|
| Sample No. 3 | 6.0 | 1700 | Herringbone |
| Comparative Sample | 6.2 | 500 | Rip stop |

As shown above, sample numbers 1-3, containing more than 10% by weight non-aromatic polyamide fibers, had dramatically better abrasion resistance characteristics than the comparative sample. In fact, the improvements in abrasion resistance are dramatic and unexpected in view of the relatively small difference in the amount of polyamide fibers present in the fabrics.

As shown above, a herringbone weave also dramatically improves abrasion resistance.

Example No. 2

The fabrics described in Example No. 1 above were also tested for other various properties. In particular, the fabrics were tested for various strength properties, shrink properties, and flame resistance.

The first test that was conducted was the "PYROMAN" Test. According to the PYROMAN Test, a fully instrumented, life-sized mannequin is donned with clothing and put into a fire resistant room. The mannequin and clothing are exposed to flash fire conditions. In one test, the mannequin is equipped with over a hundred heat sensors uniformly distributed over the surface of the mannequin. Eight industrial burners produce a flash fire for a certain period of time. The fire fully engulfs the mannequin. The sensors send information to a computer system which then predicts the amount of burns a person would have suffered. In particular, the computer system reports a predicted burn injury over the surface of the mannequin. A calculated incident heat flux is used to calculate the temperature of human tissue at two depths below the surface of the skin, one representing second degree and the other representing third degree burn injury.

In this example, the fabric described under Sample No. 3 in Example 1 above and the Comparative sample were placed on the mannequin. In particular, the fabrics were made into battle dress uniforms such as those that would be worn by the military. The shirt was left untucked from the pants in order to better simulate real life conditions. The following results were obtained:

| Total Burn Injury Prediction 2 cal/(cm$^2$*sec) – 4 seconds | | |
|---|---|---|
| Average of 3 Tests | Comparative Sample | Sample No. 3 |
| 2nd Degree Burn | 23% | 25% |
| 3rd Degree Burn | 27% | 10% |
| Total Burn Injury Prediction | 50% | 35% |

As shown above, the fabric of the present invention had a 32% reduction in total body burns and a 64% reduction in predicted third degree burns.

In addition to the PYROMAN Test as described above, the following tests were also conducted on the fabrics and the following results were obtained:

| Test Description | Test Method | Unit | Sample No. 3 | Sample No. 2 | Sample No. 1 | Comparative Sample |
|---|---|---|---|---|---|---|
| | | | Values (Warp × Fill) | | | |
| COMFORT | | | | | | |
| Thickness of Textile Materials | ASTM D 1777 | Inch | 0.018 | 0.017 | 0.017 | 0.013 |
| Air Permeability of Textile Fabrics | ASTM D 737 | CFM | 35 | 28 | 13 | 41 |
| Water Vapor Transmission of Materials | ASTM E 96 | G/M2/24H | 982 | 947 | 995 | 930 |
| Stiffness of Fabric (Circular Bend Procedure) | ASTM D 4032 | Pounds | 0.5 × 0.5 | 0.5 × 0.5 | 0.6 × 0.6 | 0.6 × 0.7 |
| Wicking of Fabrics and Fibrous Materials - after 5 MN | SAE J913 | Inch | 1.5 × 1.5 | 1.8 × 1.3 | 1.5 × 1.5 | 1.5 × 1.25 |
| Drying Time | USMC | Minutes | 35 | 35 | 40 | 50 |
| STRENGTH | | | | | | |
| Breaking Strength of Textile Fabrics (Grab Test) | ASTM D 5034 | Pounds | 206 × 139 | 205 × 126 | 211 × 157 | 146 × 120 |
| Hydraulic Bursting Strength of Fabrics (Diaphragm Bursting Tester - Mullen) | ASTM D 3786 | PSI | 220 | 220 | 230 | 130 |
| Tearing Strength of Fabrics (Falling-Pendulum Type (Elmendorf) Apparatus) | ASTM D 1424 | Pounds | 11 × 10 | 15 × 10 | 9 × 9 | 12 × 10 |
| Tearing Strength of Fabrics (Tongue (Single Rip) Procedure) | ASTM D 2261 | Pounds | 16 × 10 | 12 × 10 | 11 × 9 | 11 × 11 |
| Tearing Strength of Fabrics (Trapezoid Procedure) | ASTM D 5587 | Pounds | 41 × 22 | 39 × 23 | 35 × 23 | 15 × 10 |
| DURABILITY | | | | | | |
| Dimensional Changes after Commercial Laundering - after 5 Launderings | AATCC 96 | Percent | 2.8 × 1.7 | 2.5 × 2.3 | 3.9 × 2.3 | 2.4 × 1.5 |
| Dimensional Changes after Home Laundering - after 5 Launderings | AATCC 135 | Percent | 3 × 3 | 4 × 1 | 4 × 3 | 2.1 × 1.5 |
| HEAT & FLAME PROTECTION | | | | | | |
| Heat and Thermal Shrinkage Resistance - after 5 Minutes at 500° F. | NFPA 1971 8.6 | Percent | 5 × 4.5 | 4 × 2 | 3 × 2 | 3.0 × 3.0 |
| Flame Resistance of Textiles (Vertical Test) - After Flame | ASTM D 6413 | Seconds | 0 × 0 | 0 × 0 | 0 × 0 | 0 × 0 |
| Flame Resistance of Textiles (Vertical Test) - After Glow | ASTM D 6413 | Seconds | 7 × 8 | 7 × 7 | 8 × 6 | 2 × 2 |
| Flame Resistance of Textiles (Vertical Test) - Char Length | ASTM D 6413 | MM | 50 × 43 | 55 × 41 | 60 × 40 | 78 × 65 |
| Flame Resistance of Textiles (Vertical Test) - Drip | ASTM D 6413 | Count | 0 × 0 | 0 × 0 | 0 × 0 | 0 × 0 |
| Flame Resistance of Textiles (Vertical Test) - After Flame after 25 Home Launderings | ASTM D 6413 (AATCC 135) | Seconds | 0 × 0 | 0 × 0 | 0 × 0 | 0 × 0 |
| Flame Resistance of Textiles (Vertical Test) - After Glow after 25 Home Launderings | ASTM D 6413 (AATCC 135) | Seconds | 7 × 7 | 7 × 7 | 7 × 6 | 2 × 2 |
| Flame Resistance of Textiles (Vertical Test) - Char Length after 25 Home Launderings | ASTM D 6413 (AATCC 135) | MM | 38 × 45 | 45 × 45 | 51 × 45 | 63 × 63 |
| Flame Resistance of Textiles (Vertical Test) - Drip after 25 Home Launderings | ASTM D 6413 (AATCC 135) | Count | 0 × 0 | 0 × 0 | 0 × 0 | 0 × 0 |
| Fabric Break Open | MIL-C-83429B | Seconds | 31 | 31 | 31 | 31 |
| Thermal Protective Performance (TPP No Spacer) | NFPA 1971 8.10 | Square Seconds | 8.3 | 8.0 | 8.0 | |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A garment with flame resistant properties comprising:

a fabric shaped to cover at least a portion of a wearer's body, the fabric comprising a woven fabric made from a plurality of yarns, the yarns being made from a plurality of fibers, the plurality of fibers including inherently flame resistant fibers and cellulose fibers that have been treated with a flame resistant composition, the woven fabric having a herringbone weave.

2. A garment as defined in claim 1, wherein the plurality of fibers further includes non-aromatic polyamide.

3. A garment as defined in claim 2, wherein the yarns are made from an intimate blend of the plurality of fibers, the inherently flame resistant fibers comprising a combination of meta-aramid fibers and para-aramid fibers, the meta-aramid fibers being present in the fabric in an amount from about 30% by weight to about 60% by weight of the fabric, the cellulose fibers being present in the fabric from about 20% to about 50% by weight, the non-aromatic polyamide being present in the fabric in an amount from about 12% by weight to about 25% by weight, and the para-aramid fibers being present in an amount of less than about 15% by weight.

4. A garment as defined in claim 3, wherein the fabric contains para-aramid fibers in an amount from about 3% to about 15% by weight of the fabric.

5. A garment as defined in claim 1, wherein the flame resistant cellulose fibers comprise cotton or rayon fibers pre-treated with a fire resistant composition.

6. A garment as defined in claim 1, wherein the woven fabric has a basis weight of from about 2 osy to about 9 osy.

7. A garment as defined in claim 3, wherein the woven fabric has a taber abrasion resistance of at least about 1000 cycles according to ASTM D3884.

8. A garment as defined in claim 1, wherein the garment defines an exterior surface and wherein a camouflage pattern has been applied to the exterior surface of the garment.

9. A garment with flame resistant properties comprising:

a fabric shaped to cover at least a portion of a wearer's body, the fabric comprising a woven fabric made from a plurality of yarns, the yarns being made from a plurality of fibers, the plurality of fibers including inherently flame resistant fibers, cellulose fibers that have been treated with a flame resistant composition, and non-aromatic polyamide, the inherently flame resistant fibers, comprising producer colored aramid fibers, the producer colored aramid fibers comprising meta-aramid fibers, para-aramid fibers or mixtures thereof, the non-aromatic polyamide fibers being present in the fabric in an amount of from about 12% to about 25% by weight;

wherein the garment includes an exterior surface and an interior surface, and wherein the exterior surface has been printed with a camouflage pattern.

10. A garment as defined in claim 9, wherein the yarns are made from an intimate blend of the plurality fibers, the inherently flame resistant fibers comprising a combination of meta-aramid fibers and para-aramid fibers, the meta-aramid fibers being present in the fabric in an amount from about 30% by weight to about 60% by weight of the fabric, the cellulose fibers being present in the fabric from about 20% to about 50% by weight, and the para-aramid fibers being present in an amount of less than about 15% by weight.

11. A garment as defined in claim 10, wherein the fabric contains para-aramid fibers in an amount from about 3% to about 15% by weight of the fabric.

12. A garment as defined in claim 9, wherein the flame resistant cellulose fibers comprise cotton or rayon fibers pre-treated with a fire resistant composition.

13. A garment as defined in claim 9, wherein the woven fabric has a taber abrasion resistance of at least about 1000 cycles according to ASTM D3884.

14. A garment as defined in claim 9, wherein the woven fabric has a basis weight of from about 2 osy to about 9 osy.

15. A garment as defined in claim 9, wherein the fabric is dyed a base shade and then printed to produce the camouflage pattern.

16. A garment as defined in claim 9, wherein the camouflage pattern comprises vat dyes.

17. A garment as defined in claim 15, wherein the camouflage pattern comprises vat dyes.

18. A garment as defined in claim 9, wherein the printed camouflage pattern has been oxidized.

19. A garment as defined in claim 9, wherein the camouflage pattern uses only dyes that have a reflectance of less than about 70% over a range of wavelengths of from about 600 nm to about 1,000 nm.

* * * * *